US010955769B2

(12) United States Patent
Sandler et al.

(10) Patent No.: US 10,955,769 B2
(45) Date of Patent: Mar. 23, 2021

(54) LIQUID CARRIER COLLECTION

(71) Applicant: HP INDIGO B.V., Amstelveen (NL)

(72) Inventors: Mark Sandler, Ness Ziona (IL); Peter Nedelin, Ness Ziona (IL); Assaf Pines, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/493,954

(22) PCT Filed: Apr. 5, 2017

(86) PCT No.: PCT/EP2017/058164

§ 371 (c)(1),
(2) Date: Sep. 13, 2019

(87) PCT Pub. No.: WO2018/184679

PCT Pub. Date: Oct. 11, 2018

(65) Prior Publication Data

US 2020/0081375 A1 Mar. 12, 2020

(51) Int. Cl.

| | |
|---|---|
| ***G03G 15/11*** | (2006.01) |
| ***G03G 15/10*** | (2006.01) |
| ***G03G 21/10*** | (2006.01) |
| *G03G 21/00* | (2006.01) |

(52) U.S. Cl.

CPC ..... *G03G 15/107* (2013.01); *G03G 15/11* (2013.01); *G03G 21/10* (2013.01); *G03G 21/0088* (2013.01)

(58) Field of Classification Search

CPC ..... G03G 15/107; G03G 15/11; G03G 21/10; G03G 21/0088; G03G 2221/0005; G03G 2221/003

See application file for complete search history.

(56) References Cited

U.S. PATENT DOCUMENTS

| | | | | |
|---|---|---|---|---|
| 573,767 | A | 12/1896 | Denayrouze | |
| 5,737,674 | A * | 4/1998 | Venkatesan | G03G 15/107 399/250 |
| 5,884,128 | A | 3/1999 | Park | |
| 5,996,975 | A | 12/1999 | Shin | |
| 6,400,920 | B1 * | 6/2002 | Saitoh | B01D 53/002 399/249 |
| 6,804,487 | B2 | 10/2004 | Yokota | |

(Continued)

FOREIGN PATENT DOCUMENTS

| | | |
|---|---|---|
| CN | 1220419 A | 6/1999 |
| JP | 54143146 | 11/1979 |

(Continued)

OTHER PUBLICATIONS

HP Indigo Digital Offset Color Technology, Mar. 5, 2012, <http://www.crosstechinc.com/PDFs/US_Tech%20WP_LR.pdf >.

*Primary Examiner* — Walter L Lindsay, Jr.
*Assistant Examiner* — Laura Roth
(74) *Attorney, Agent, or Firm* — Mannava & Kang

(57) ABSTRACT

An example method of collecting liquid carrier from a vapour in a printing system includes: heating a vapour carrying a liquid carrier and passing the heated vapour carrying liquid carrier through a volume of liquid carrier. Liquid carrier carried in the heated vapour condenses into the volume of liquid carrier as it passes through the volume of liquid carrier.

13 Claims, 6 Drawing Sheets

(56) References Cited

U.S. PATENT DOCUMENTS

| | | | | |
|---|---|---|---|---|
| 2004/0033086 | A1* | 2/2004 | Vejtasa | G03G 15/107<br>399/237 |
| 2004/0071480 | A1* | 4/2004 | Vejtasa | G03G 15/11<br>399/250 |

FOREIGN PATENT DOCUMENTS

| | | |
|---|---|---|
| JP | 2000162876 | 6/2000 |
| KR | 100261083 | 7/2000 |

* cited by examiner

LIQUID CARRIER COLLECTION

BACKGROUND

In an example printing apparatus, particularly a liquid electrophotographic (LEP) printer, improved printing quality is achieved by mixing a toner with a liquid carrier. The liquid carrier is not printed onto a print medium; it is removed, for example by evaporation, and recovered for further use.

BRIEF DESCRIPTION OF THE DRAWINGS

Various features of the present disclosure will be apparent from the detailed description which follows, taken in conjunction with the accompanying drawings, which together illustrate, by way of example only, features of the present disclosure, and wherein.

DETAILED DESCRIPTION

Figure 1:
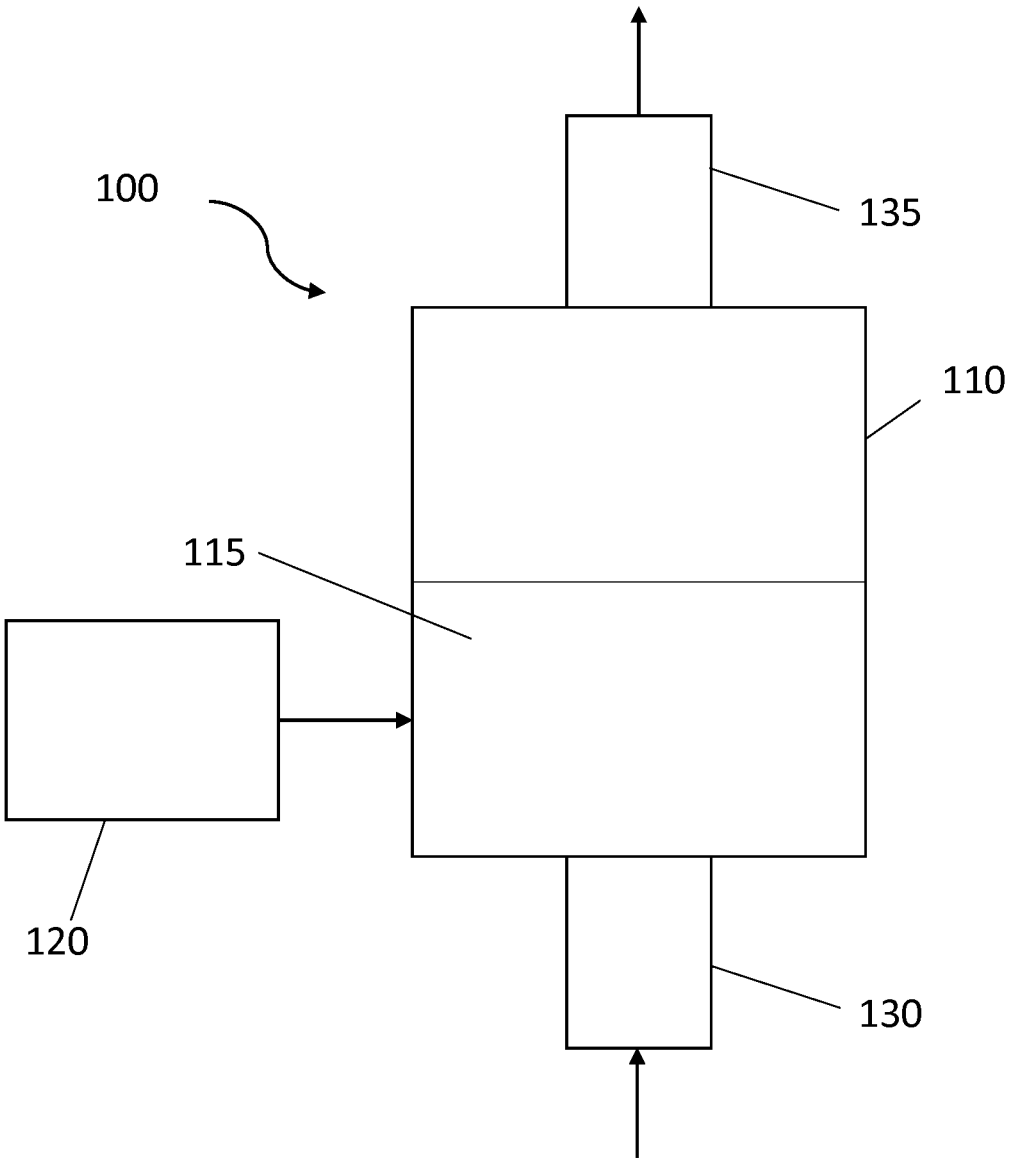
FIG. 1 is a schematic diagram of an apparatus in accordance with an example.

In the following description, for purposes of explanation, numerous specific details are set forth in order to provide a thorough understanding of the present apparatus, systems and methods. It will be apparent, however, that the present apparatus, systems and methods may be practiced without these specific details. Reference in the specification to "an example" or similar language means that a particular feature, structure, or characteristic described in connection with the example is included in at least that one example, but not necessarily in other examples.

In some printing systems, for example in an LEP printer, improved printing quality is achieved by mixing a toner with a liquid carrier. Liquid carrier is not printed onto a print medium; it is recovered for further use. In an example printing apparatus, liquid carrier is evaporated by using heated elements in the printing system. Evaporated liquid carrier forms a vapour comprising liquid carrier; evaporated liquid carrier is suspended in the air within the printing system. The vapour is removed from a vicinity within the printing system where liquid carrier is evaporated, before being condensed. Condensed liquid carrier can be recovered and returned to a store of liquid carrier ready to again be used by the printing system in a printing process. Some liquid carriers used in printing systems are toxic, and printing systems are therefore often sealed to prevent the escape of vapour comprising liquid carrier to the atmosphere. Liquid carrier that is not condensed therefore continues to circulate inside the printing system, which can contribute to a deterioration in print quality achieved by the printing system.

As the output of printers has increased through technological advances, so the speed of evaporation and condensation of liquid carrier has also increased. Air inside the printer is therefore circulated at ever-increasing speeds to remove vapour comprising liquid carrier from the vicinity within the printing system where liquid carrier is evaporated. A high-speed air circulation system within a printing system can contribute significantly to the noise generated by the printing system, and can add to the cost, power consumption and size of the printing system.

Some commercially-available printing systems comprise a heat exchanger and a filtering element. Vapour comprising liquid carrier is passed through the heat exchanger, causing the temperature of the vapour to drop rapidly. The vapour condenses and forms small droplets of liquid carrier. Some of the droplets are caught on the fins of the heat exchanger, but the majority exit the heat exchanger with the air. Air carrying small droplets of liquid carrier is then passed through the filtering element, which separates the droplets from the air and collects them. Such configurations involve use of high pressure due to the pressure drop caused by the heat exchanger and filtering element, and can be adversely affected by a build-up of liquid carrier. In such systems, a trade-off between acceptable pressure drop and efficiency of carrier collection is needed. Therefore, air within the printing system can become contaminated with liquid carrier droplets that are not collected by the filtering element. A lower complexity, more efficient apparatus is needed to recover liquid carrier in printing systems, particularly high-output LEP printing systems.

FIG. 1 shows an example apparatus 100 comprising a reservoir 110 to store a volume of liquid carrier 115, a cooler 120 to cool the volume of liquid carrier 115 stored in the reservoir 110, an inlet duct 130 to cause a vapour comprising liquid carrier to pass through the liquid carrier 115 stored in the reservoir 110, and an outlet duct 135. As the vapour passes through the liquid carrier 115 stored in the reservoir 110, the liquid carrier comprised in the vapour is condensed to join the liquid carrier 115 stored in the reservoir 110.

In the example of FIG. 1, the inlet duct 130 is a pipe or series of pipes. The inlet duct 130 connects a vicinity where liquid carrier is evaporated within the printing system with which the apparatus 100 is used, to the reservoir 110. In the example of FIG. 1, the inlet duct 130 is positioned at the bottom of the reservoir 110. This example allows the vapour to pass from the inlet duct 130 into the reservoir 110 passively, that is, without an active element that pushes or draws the vapour to the inlet duct 130. Vapour rises through the inlet duct 130 and through the liquid carrier 115 stored in the reservoir 110 due to gravity. This configuration helps to reduce the complexity of the apparatus 100 by reducing the number of components used to condense and recover liquid carrier. In other examples, the inlet duct 130 is positioned at any other suitable location relative to the reservoir 110, for example at a side of the reservoir 110. In some examples, the apparatus 100 comprises a pump and/or other mechanism for actively circulating the vapour through the apparatus 100. The apparatus 100 can comprise a plurality of inlet ducts 130.

In the example of FIG. 1, the cooler 120 actively cools the volume of liquid carrier 115 stored in the reservoir 110. Condensation of the vapour passed through the liquid carrier 115 is more efficient when the volume of liquid carrier 115 is cooled by the cooler 120 because the temperature difference between the liquid carrier 115 and the vapour is increased. The volume of liquid carrier 115 is cooled by the cooler 120 to a predetermined temperature that is lower than an internal working temperature of a printing system with which the apparatus 100 is used. In some examples, the volume of liquid carrier 115 is cooled by the cooler 120 to a predetermined temperature of 10° C. or less, 5° C. or less, or 0° C. or less.

In the example of FIG. 1, the cooler 120 is a cooling jacket that covers at least a portion of the surface of the reservoir 110. In other examples, the cooler 120 is of any other suitable form to cool the volume of liquid carrier 115 stored in the reservoir 110 to the predetermined temperature.

In some examples, the predetermined temperature of the liquid carrier 115 is variable. The predetermined temperature of the liquid carrier 115 is dependent on, by way of example only, the printing output of the printing system with which the apparatus 100 is used, the internal working temperature of the printing system with which the apparatus 100 is used and/or the temperature of the vapour that is passed through the inlet duct 130 into the reservoir 110 by the apparatus 100.

In some examples, the reservoir 110 comprises insulation (not shown) to help maintain the volume of liquid carrier 115 at the predetermined temperature, and thereby to help increase the efficiency of the apparatus 100.

The apparatus 100 comprises an outlet duct 135, through which air from which liquid carrier has been separated, exits the apparatus 100. In some examples, the outlet duct 135 releases air to the atmosphere outside the printing system with which the apparatus 100 is used.

Figure 7:
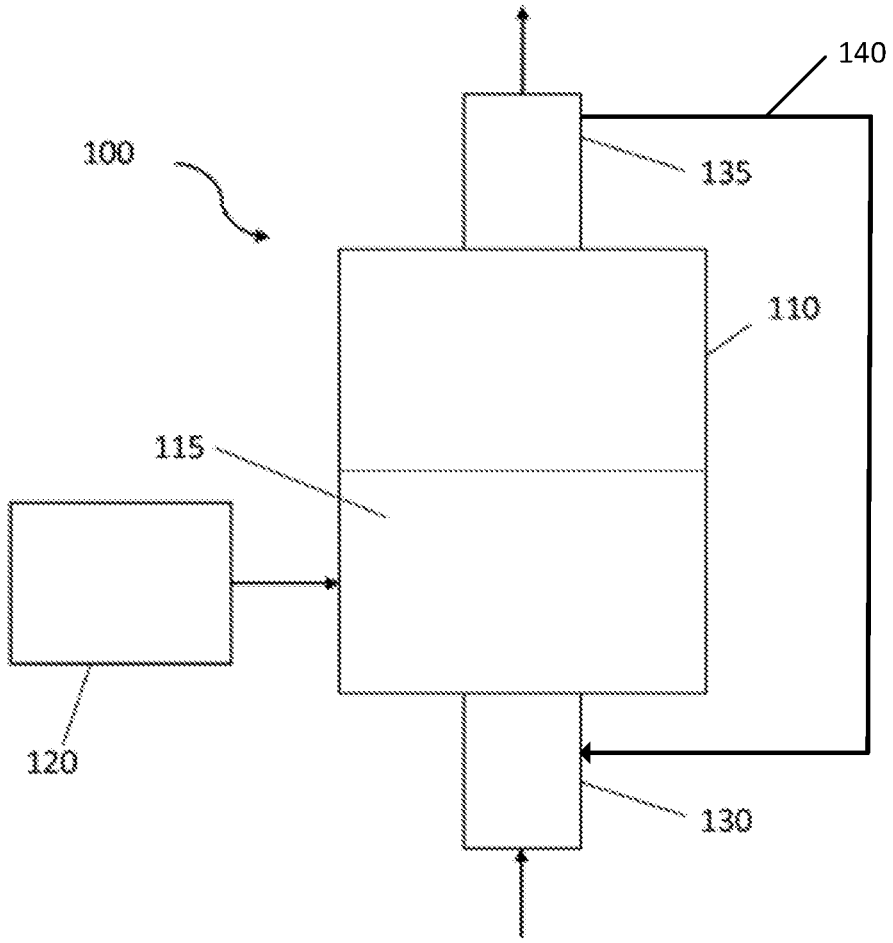
FIG. 7 is a schematic diagram of an apparatus in accordance with an example.

In some examples, and as shown in FIG. 7, the outlet duct 135 comprises a duct 140 that directs air that has passed through the volume of liquid carrier 115 stored in the reservoir 110 to the inlet duct 130 so that the air can be passed through the volume of liquid carrier 115 stored in the reservoir 110 at least twice. This configuration can help to increase the efficiency of the apparatus 100, because a subsequent pass through the volume of liquid carrier 115 can increase the amount of liquid carrier removed from the air.

Figure 2:
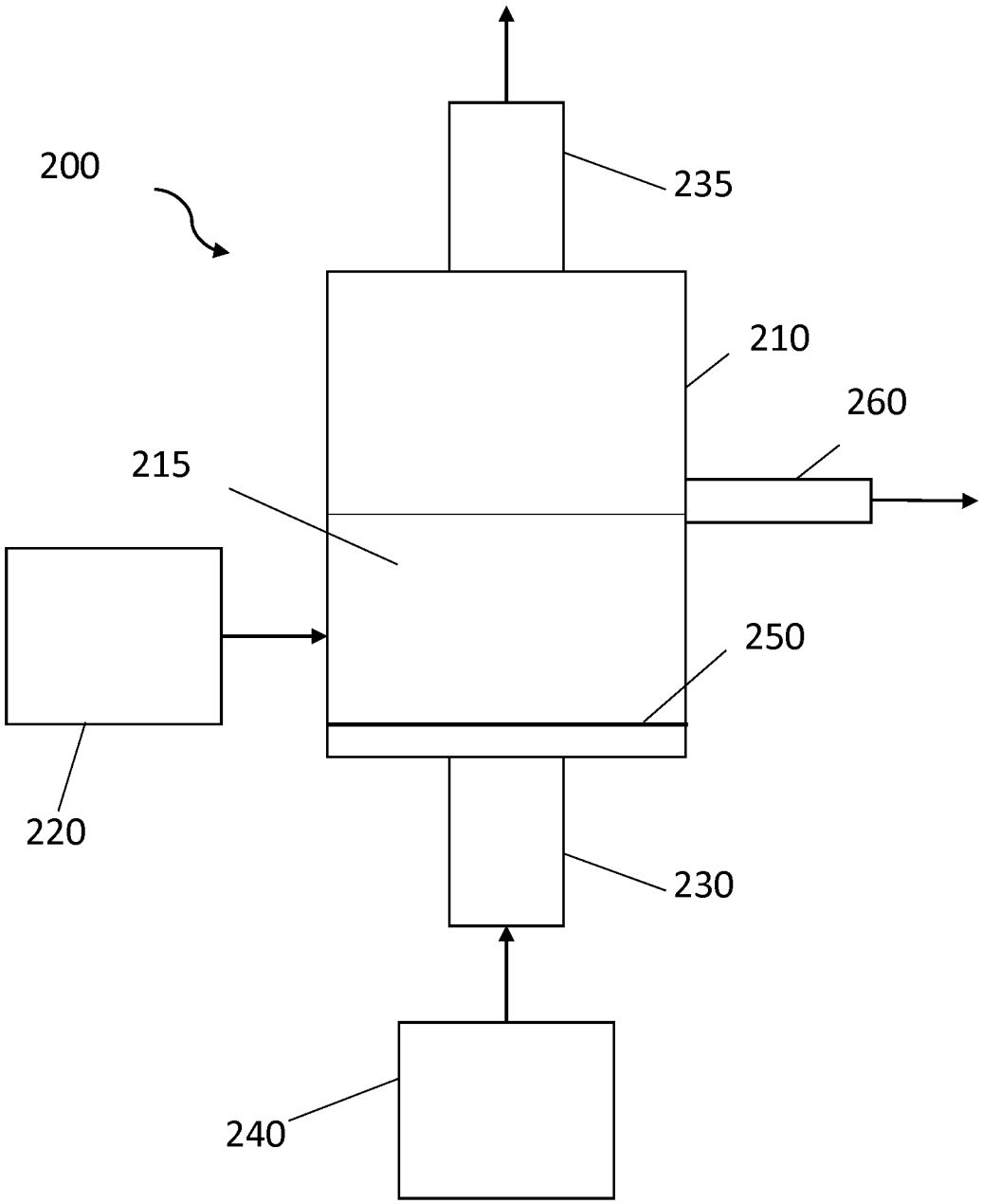
FIG. 2 is a schematic diagram of an apparatus in accordance with an example.

FIG. 2 shows an example apparatus 200 comprising a reservoir 210 to store a volume of liquid carrier 215, a cooler 220 to cool the volume of liquid carrier 215 stored in the reservoir 210, an inlet duct 230 to cause a vapour comprising liquid carrier to pass through the liquid carrier 215 stored in the reservoir 210, and an outlet duct 235. The reservoir 210, cooler 220, inlet duct 230 and outlet duct 235 are in accordance with the reservoir 110, cooler 120, inlet duct 130 and outlet duct 135 described with reference to FIG. 1. In the example of FIG. 2, the apparatus 200 comprises a heater 240, a mesh 250 and an overflow duct 260. In some examples, the apparatus 200 does not comprise a cooler 220.

Figure 3:
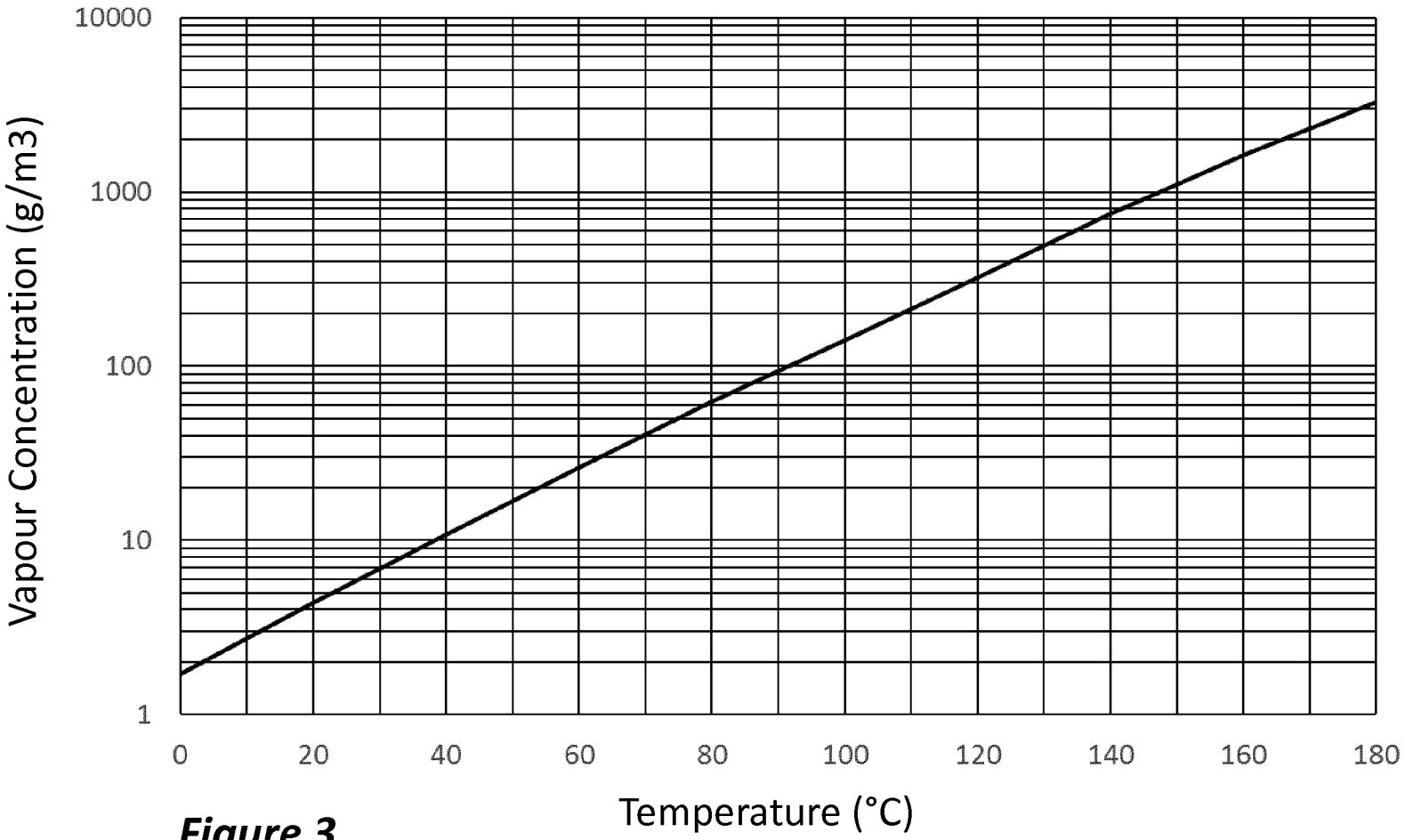
FIG. 3 is a graph plotting air temperature versus vapour concentration.

The example apparatus 200 comprises a heater 240 that is to heat vapour comprising liquid carrier prior to the vapour passing through the liquid carrier 215 stored in the reservoir 210. In some examples, the heater 240 is configured to heat vapour within a vicinity of a printing system with which the apparatus 200 is used where liquid carrier is evaporated. The vapour comprises air and evaporated liquid carrier. Hotter air is able to carry a higher concentration of evaporated liquid carrier than cooler air, as shown in FIG. 3 (described in more detail below). Accordingly, air heated by the heater 240 can carry a greater concentration of evaporated liquid carrier per unit volume, compared to air that is not heated by the heater 240. An apparatus 200 comprising a heater 240 can therefore help to allow the printing system with which the apparatus 200 is used to be operated with a reduced flow rate of air, thus helping to reduce the cost, power consumption and noise of the printing system. This is particularly beneficial with high-output printing systems.

In some examples, the heater 240 heats the vapour to a predetermined temperature. The predetermined temperature can be variable to control the concentration of the liquid carrier comprised in the vapour. The predetermined temperature can be dependent on, by way of example only, the type of liquid carrier comprised in the vapour, the printing output of the printing system with which the apparatus 200 is used, the internal working temperature of the printing system with which the apparatus 200 is used and/or the temperature of the liquid carrier 215 stored in the reservoir 210. In some examples, the apparatus 200 does not comprise a heater 240.

In some examples, the heater 240 is configured to heat vapour comprising liquid carrier to a predetermined temperature of at least 100° C. In some examples, the heater 240 is configured to heat vapour comprising liquid carrier to a predetermined temperature of at least 120° C., or at least 150° C., or between 150° C. and 170° C. The predetermined temperature to which the vapour is heated does not exceed a temperature which adversely affects the quality of printing attained by the printing system with which the apparatus 200 is used.

In the example apparatus 200, vapour heated by the heater 240 enters the reservoir 210 via the inlet duct 230, as described with reference to FIG. 1. The example apparatus 200 comprises a heater 240 and a cooler 220, so the difference in temperature between the heated vapour and liquid carrier 215 stored in the reservoir 210 is maximized. A greater difference in temperature between the heated vapour and liquid carrier 215 stored in the reservoir 210, helps liquid carrier comprised in the vapour to condense faster as it passes through liquid carrier 215 stored in the reservoir 210. This can decrease the amount of liquid carrier that remains in the air that exits the apparatus 200 via the outlet duct 235.

In the example of FIG. 2, the apparatus 200 comprises a mesh 250 to reduce the size of bubbles of vapour passing through liquid carrier 215 stored in the reservoir 210. In other example, the apparatus 250 does not comprise a mesh 250. The term "mesh" is to be interpreted broadly as any component suitable for reducing the size of bubbles of vapour passing through liquid carrier 215 stored in the reservoir 210. In some examples, the apparatus 200 comprises two or more meshes 250 that incrementally reduce bubble size as the vapour rises toward the surface of liquid carrier 215 stored in the reservoir 210. In some examples, the mesh 250 has a shape that is substantially the same as a cross-section of the reservoir 210. In some examples, the mesh 250 is positioned where the inlet duct 230 interfaces with the reservoir 210.

In some examples, the apparatus 200 comprises an overflow duct 260 to regulate the volume of liquid carrier 215 stored in the reservoir 210. Evaporated liquid carrier that condenses to join liquid carrier 215 stored in the reservoir 210 causes the volume of liquid carrier 215 stored in the reservoir 210 to increase. The overflow duct 260 is positioned to remove surplus liquid carrier 215 stored in the reservoir 210 from the reservoir 210. In some examples, the overflow duct 260 returns the surplus liquid carrier to a store (not shown) to be re-used by the printing system with which the apparatus 200 is used.

FIG. 3 shows a graph plotting air temperature versus vapour concentration. Temperature (in degrees centigrade) is given on the horizontal axis with a linear scale. Vapour concentration (in grams per cubic metre) is depicted on the vertical axis, with a logarithmic scale. The graph shows that increasing vapour temperature from 30° C. (a typical operating temperature of current printing systems) to 165° C. (an operating temperature of an example apparatus) increases vapour concentration by a factor of almost 300. Therefore, an example apparatus comprising a heater can help to reduce the flow rate of air for removing evaporated liquid carrier from a vicinity within a printing system with which the apparatus is used, where evaporation of liquid carrier occurs.

Figure 4:
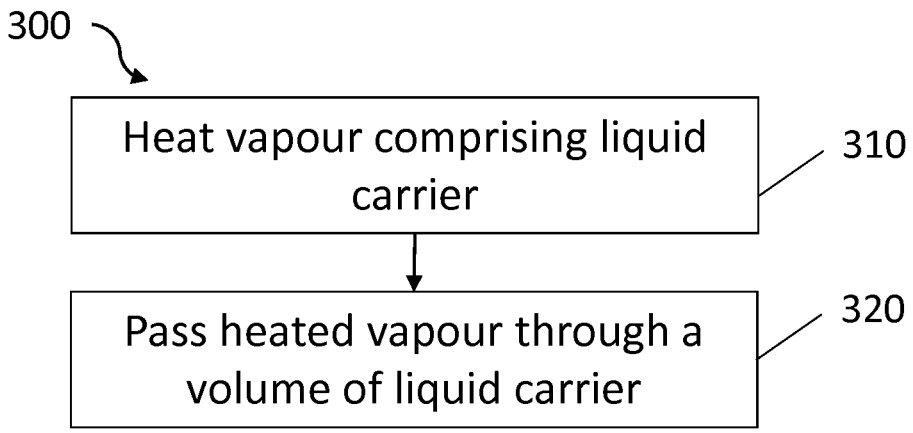
FIG. 4 is a flow diagram illustrating a method of collecting liquid carrier from a vapour in a printing system in accordance with an example.

FIG. 4 shows a flow diagram illustrating an example method 300 of collecting liquid carrier from a vapour in a printing system. The method 300 comprises heating a vapour comprising liquid carrier 310, and passing the heated vapour comprising liquid carrier through a volume of liquid carrier 320. Liquid carrier comprised in the heated vapour condenses into the volume of liquid carrier as it passes through the volume of liquid carrier. The method can be performed by the example apparatus 200.

In some examples, the heating comprises heating the vapour comprising liquid carrier 340 above an internal working temperature of the printing system. In some examples, the method 300 comprises heating the vapour comprising liquid carrier 310 to a temperature of at least 100° C., or at least 150° C., or between 150° C. and 170° C. Heating the vapour 310 increases the concentration of liquid carrier in the vapour.

Figure 5:
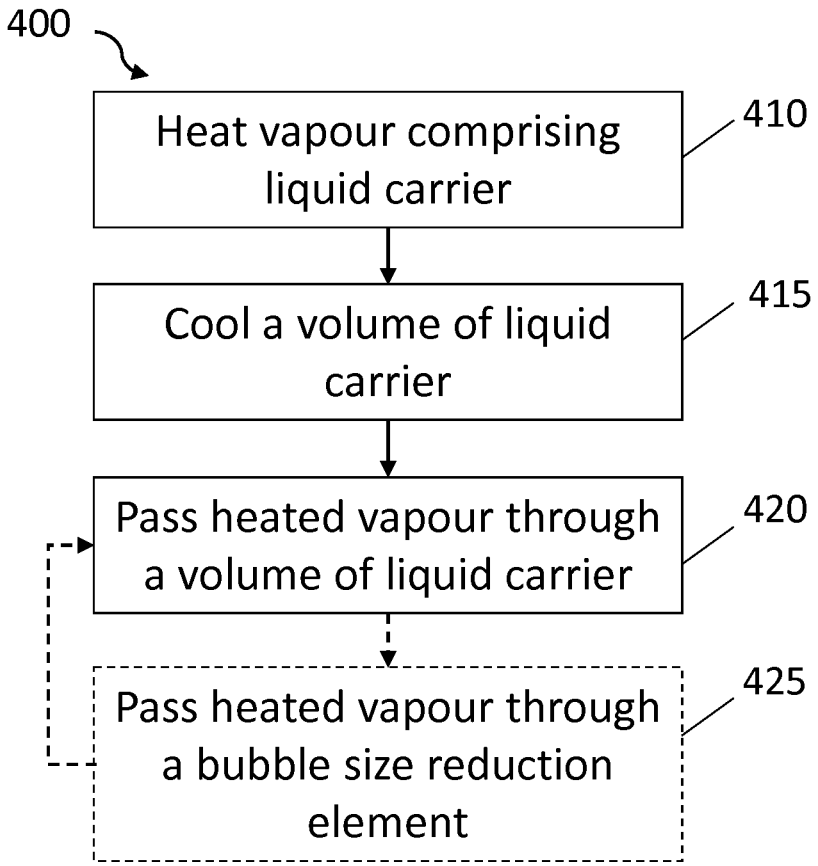
FIG. 5 is a flow diagram illustrating a method of collecting liquid carrier from a vapour in a printing system in accordance with an example.

FIG. 5 shows a flow diagram illustrating an example method 400 of collecting liquid carrier from a vapour in a printing system. The method 400 comprises heating a vapour comprising liquid carrier 410, cooling a volume of liquid carrier 415, and passing the heated vapour comprising liquid carrier through the volume of liquid carrier 420. Liquid carrier comprised in the heated vapour condenses into the volume of liquid carrier as it passes through the volume of liquid carrier. The heated vapour comprising liquid carrier rises through the volume of liquid carrier as bubbles. In some examples, the heating 410 is the same as the heating 310 of example method 300. In other examples, the method 400 does not comprise heating vapour comprising liquid carrier 410. The method can be performed by any of the example apparatus 100, 200 described herein and shown in FIGS. 1 and 2.

In some examples, the cooling comprises cooling the volume of liquid carrier 415 below an internal working temperature of the printing system. In some examples, the cooling comprises cooling the volume of liquid carrier 415 to 10° C. or less, or to 0° C. or less.

In some examples, the method 400 comprises passing the heated vapour comprising liquid carrier through a bubble size reduction element 425 such that the size of the bubbles is reduced. In some examples, the bubble size reduction element comprises a mesh. A reduction in bubble size results in a greater surface area of the bubbles rising through the liquid carrier, which in turn increases the speed at which liquid carrier comprised in the heated vapour condenses.

In some examples, the method 400 comprises passing the heated vapour comprising liquid carrier through the volume of liquid carrier at least twice. In some examples where the vapour is not heated, the method 400 comprises passing the vapour comprising liquid carrier through the volume of liquid carrier at least twice. This can increase the efficiency of the method 400 by increasing the proportion of liquid carrier comprised in the vapour that condenses.

Figure 6:
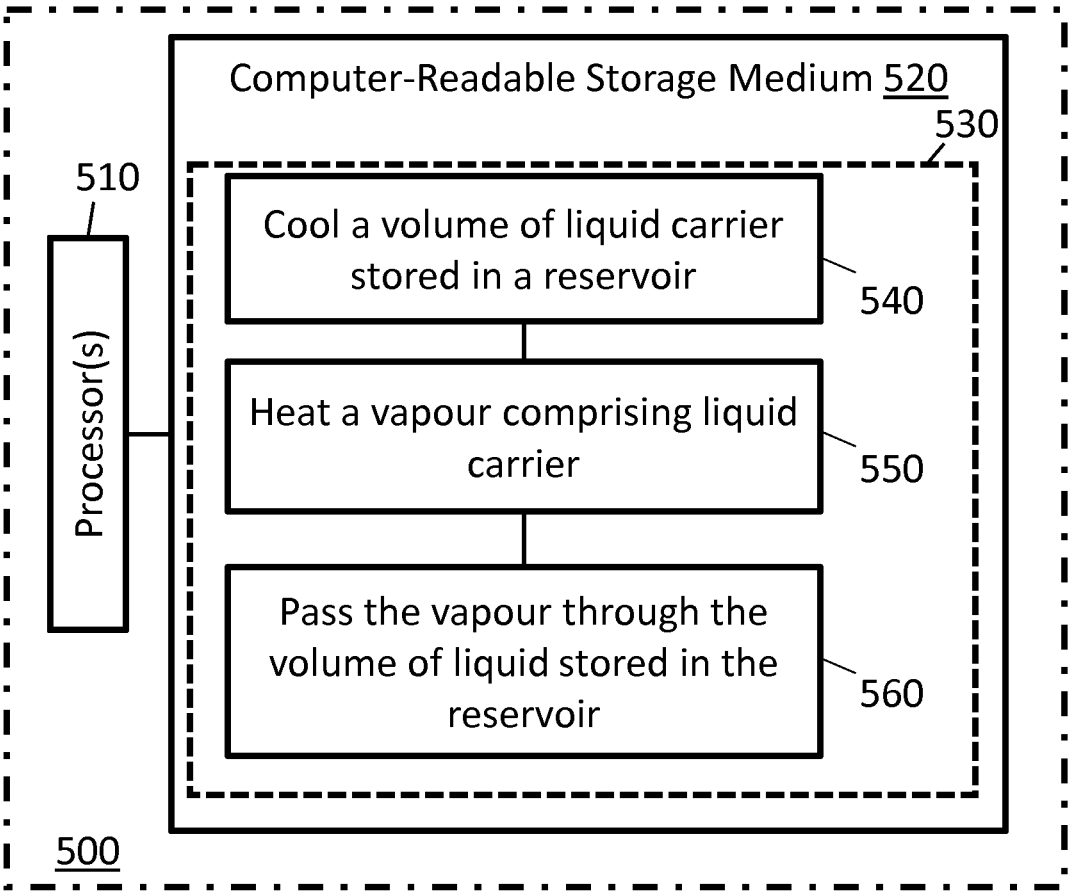
FIG. 6 is a schematic diagram of a non-transitory computer-readable storage medium in accordance with an example.

FIG. 6 shows a schematic diagram of an example non-transitory computer-readable storage medium 520 storing a instructions 530 that, if executed by a processor 510 of a printing system 500, cause the processor 510 to perform a method of controlling the printing system 500. The instructions 530 comprise an instruction to cool a volume of liquid carrier stored in a reservoir 540, an instruction to heat a vapour comprising liquid carrier 550, and an instruction to pass the vapour through the volume of liquid carrier stored in the reservoir to condense liquid carrier comprised in the vapour 560.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method of collecting liquid carrier from a vapour in a printing system, the method comprising:

heating a vapour comprising liquid carrier;

passing the heated vapour comprising liquid carrier through an inlet duct positioned beneath a reservoir containing liquid carrier;

passing the heated vapour comprising liquid carrier upwardly from the inlet duct through a volume of liquid carrier contained in the reservoir; and cooling the volume of liquid carrier to 0° C. or less, wherein liquid carrier comprised in the heated vapour condenses into the volume of liquid carrier contained in the reservoir as the condensed liquid carrier comprised in the heated vapour passes through the volume of liquid carrier.

2. A method according to claim 1, wherein the heated vapour comprising liquid carrier rises through the volume of liquid carrier as bubbles, and wherein the method further comprises passing the heated vapour comprising liquid carrier through a bubble size reduction element such that the size of the bubbles is reduced.

3. A method according to claim 1, wherein the heating comprises heating the vapour comprising liquid carrier above an internal working temperature of the printing system.

4. A method according to claim 3, wherein the heating comprises heating the vapour comprising liquid carrier to at least 100° C.

5. A method according to claim 3, wherein the heating comprises heating the vapour comprising liquid carrier to at least 150° C.

6. A method according to claim 1, wherein the cooling comprises cooling the volume of liquid carrier to less than 0° C.

7. A method according claim 1, comprising passing the heated vapour comprising liquid carrier through the volume of liquid carrier at least twice.

8. An apparatus for use in a printing system, the apparatus comprising;

a reservoir to store a volume of liquid carrier;

a cooler to cool the volume of liquid carrier stored in the reservoir to 0° C. or less; and an inlet duct positioned beneath the reservoir to cause a vapour comprising liquid carrier to pass upwardly from the inlet duct through the volume of liquid carrier stored in the reservoir, wherein liquid carrier comprised in the vapour condenses to join the liquid carrier stored in the reservoir.

9. An apparatus according to claim 8, comprising a heater to heat the vapour prior to the vapour passing upwardly from the inlet duct through the volume of liquid carrier stored in the reservoir.

10. An apparatus according to claim 8, comprising a mesh to reduce the size of bubbles of vapour passing through the volume of liquid carrier stored in the reservoir.

11. An apparatus according to claim 8, comprising an overflow duct to regulate the volume of liquid carrier stored in the reservoir.

12. An apparatus according to claim 8, wherein the cooler is to cool the volume of liquid carrier to less than 0° C.

13. A non-transitory computer-readable storage medium storing instructions that, when executed by a processor of a printing system, cause the processor to:

control a cooler to cool a volume of liquid carrier stored in a reservoir to less than 0° C.; and control a heater to heat a vapour comprising liquid carrier, wherein the heated vapour comprising liquid carrier is passed through an inlet duct positioned below the reservoir containing the volume of liquid carrier and the vapour is passed through the volume of liquid carrier stored in the reservoir to condense liquid carrier comprised in the vapour.

* * * * *